US009114545B2

(12) United States Patent
Lynen et al.

(10) Patent No.: US 9,114,545 B2
(45) Date of Patent: Aug. 25, 2015

(54) EDGE PUNCH SYSTEM

(75) Inventors: Stefanie Lynen, Brooklyn, NY (US); Megen Mingchen Lee, Brooklyn, NY (US)

(73) Assignee: Martha Stewart Living Omnimedia, Inc., New York, NY (US)

( * ) Notice: Subject to any disclaimer, the term of this patent is extended or adjusted under 35 U.S.C. 154(b) by 671 days.

(21) Appl. No.: 12/543,331

(22) Filed: Aug. 18, 2009

(65) Prior Publication Data

US 2011/0041662 A1 Feb. 24, 2011

(51) Int. Cl.

| | |
|---|---|
| ***B26D 3/00*** | (2006.01) |
| ***B26D 5/08*** | (2006.01) |
| ***B26D 7/02*** | (2006.01) |
| ***B26D 5/00*** | (2006.01) |
| ***B27B 3/00*** | (2006.01) |
| ***B26F 1/36*** | (2006.01) |
| ***B26D 7/01*** | (2006.01) |
| *B26D 3/10* | (2006.01) |

(52) U.S. Cl.

CPC . *B26F 1/36* (2013.01); *B26D 7/015* (2013.01); *B26D 3/10* (2013.01)

(58) Field of Classification Search

CPC ..... B26D 7/015; B26D 9/00; B26D 11/00; B26F 1/36; B26F 1/14; B26F 1/04; B26F 1/22; B26F 1/00; B26F 1/32; B31D 1/0043

USPC ..... 83/39, 620, 684, 687, 618, 83/467.1–468.94, 821, 823, 829; 30/364, 30/363, 366; 234/119

See application file for complete search history.

(56) References Cited

U.S. PATENT DOCUMENTS

| | | | | |
|---|---|---|---|---|
| 1,375,721 | A * | 4/1921 | Nichols | 83/552 |
| 2,017,195 | A * | 10/1935 | Anderson et al. | 83/146 |
| 3,446,105 | A * | 5/1969 | Herzog | 83/146 |
| 4,509,397 | A * | 4/1985 | Mori et al. | 83/453 |
| 5,067,242 | A * | 11/1991 | Singer | 30/364 |
| 5,495,671 | A * | 3/1996 | Shun-Yi | 30/364 |
| 5,749,278 | A | 5/1998 | Lee et al. | |
| 5,927,357 | A * | 7/1999 | Welsh et al. | 144/130 |
| 5,967,786 | A * | 10/1999 | Wang | 434/82 |
| 6,209,434 | B1 * | 4/2001 | Kim et al. | 83/549 |

(Continued)

FOREIGN PATENT DOCUMENTS

| | | |
|---|---|---|
| DE | 3534805 | 4/1987 |
| DE | 3534805 A1 | 4/1987 |

(Continued)

OTHER PUBLICATIONS

European Search Report dated Feb. 24, 2011 for European Patent Application No. 10251438.7.

(Continued)

*Primary Examiner* — Ghassem Alie
*Assistant Examiner* — Bharat C Patel
(74) *Attorney, Agent, or Firm* — Flaster/Greenberg P.C.

(57) ABSTRACT

The invention relates to a die-cut edge system, method and device capable of creating a continuous and congruent decorative design along the edge of a paper product. Furthermore, the invention relates to a die-cut edge system, method and device, wherein a corner punch and edge punch are aligned and correspond with one another so as to produce a continuous and congruent decorative design along the edge of a paper product.

13 Claims, 6 Drawing Sheets

(56) References Cited

U.S. PATENT DOCUMENTS

| | | | | |
|---|---|---|---|---|
| 6,513,413 | B2 | 2/2003 | Lee | |
| 6,560,891 | B1 * | 5/2003 | Arnold | 33/670 |
| RE38,219 | E | 8/2003 | Lee et al. | |
| 6,742,431 | B1 * | 6/2004 | Oh | 83/687 |
| 6,752,058 | B2 * | 6/2004 | Oh | 83/620 |
| 7,055,563 | B2 * | 6/2006 | Logan | 144/286.5 |
| 7,201,101 | B2 * | 4/2007 | Oh | 101/3.1 |
| 2002/0108481 | A1 * | 8/2002 | Logan | 83/471.3 |
| 2003/0037657 | A1 * | 2/2003 | Oh et al. | 83/620 |
| 2005/0039590 | A1 * | 2/2005 | Weng | 83/684 |
| 2005/0211036 | A1 * | 9/2005 | Oh | 83/467.1 |
| 2007/0180969 | A1 * | 8/2007 | Kanasashi et al. | 83/684 |
| 2007/0221030 | A1 * | 9/2007 | Oh | 83/684 |
| 2008/0022829 | A1 * | 1/2008 | Brosmith et al. | 83/620 |
| 2008/0121083 | A1 * | 5/2008 | Kim et al. | 83/821 |
| 2008/0223190 | A1 * | 9/2008 | Bae | 83/549 |
| 2008/0282866 | A1 * | 11/2008 | Bae | 83/687 |
| 2009/0000442 | A1 * | 1/2009 | Peterson et al. | 83/56 |
| 2009/0049971 | A1 * | 2/2009 | Yamashita et al. | 83/468 |

FOREIGN PATENT DOCUMENTS

| | | |
|---|---|---|
| EP | 2027977 | 2/2009 |
| EP | 2027977 A1 | 2/2009 |

OTHER PUBLICATIONS

European Search Report dated Dec. 8, 2010 for European Patent Application No. 10251438.7.

* cited by examiner

EDGE PUNCH SYSTEM

FIELD OF THE INVENTION

The present subject matter relates to the field of arts and crafts; specifically, to a system and device for creating a decorative die-cut edge along one or more sides and/or corners of an item.

BACKGROUND OF THE INVENTION

A variety of edge punch devices are available in the art. These devices allow a user to create a decorative edge design along an item of paper, cardstock, poster material or the like (collectively referred to herein as "paper"). The devices generally operate through the use of a two-component die. An item of paper is slid into the punch device, and upon squeezing the handle of the device, the upper part of the die travels down towards and then through the paper, into the lower part of the die; thereby cutting the paper and creating the desired decorative edge. One limitation of commercially available edge punch devices is that their generally long horizontal shape creates storage challenges; that is, the devices take up a significant amount of room when stored, and storage space may be at a premium on, for instance, a crafts table, or arts and crafts box.

A variety of corner punch devices are also available in the art, and operate in a similar fashion. However, as the name suggests, corner punch devices are used to impart a decorative design to the corner of an item of paper. These devices also generally operate through the use of a two-component die. The corner of an item of paper is slid into the corner punch device, and upon squeezing the handle of the device, the upper part of the die travels down towards and then through the paper, into the lower part of the die; thereby cutting the corner of the paper and creating the desired decorative corner.

Edge and corner punches that impart complementary designs are available in the art, and are meant to allow a user to create a decorative edge along one or more sides of an item of paper, and to also create a complementary corner design on one or more corners of the same item of paper. For instance, one might use complimentary edge and corner punches that each impart a snowflake design along the edges and corners of an item of paper to create an item for a scrapbook, an invitation to a party, a gift card, or a variety of other items as will be readily appreciated by those of skill in the art.

A significant limitation of conventional edge and corner punch systems is that while they may offer complementary designs, they are not configured for use together in a manner that ensures the design imparted by the edge punch and that imparted by the corner punch align properly with one another and hence correspond with one another. In practice, it is generally the case that the design produced by the edge punch does not align with the design produced by the corner punch, leading to a misaligned decorative edge design. As the principal purpose of decorative edging is to impart a visually pleasing element to the paper product, the misaligned edging frustrates this overall purpose, producing a irregular visual impression.

Accordingly, there exists a need in the art for a die-cut edge system, method and device capable of creating a continuous, corresponding and congruent decorative design along the edge of a paper product. Furthermore, there exists a need in the art for a die-cut edge system, method and device, wherein the corner punch and edge punch are easily aligned with one another so as to produce a continuous, corresponding and congruent decorative design along the edge of a paper product. In addition there exists a need in the art for a die-cut edge system and device that is compact and easy to store.

BRIEF DESCRIPTION OF THE DRAWINGS

Exemplary embodiments are illustrated in referenced figures, where like numerals represent similar items. It is intended that the embodiments and figures disclosed herein are to be considered illustrative rather than restrictive.

DETAILED DESCRIPTION

Figure 1:
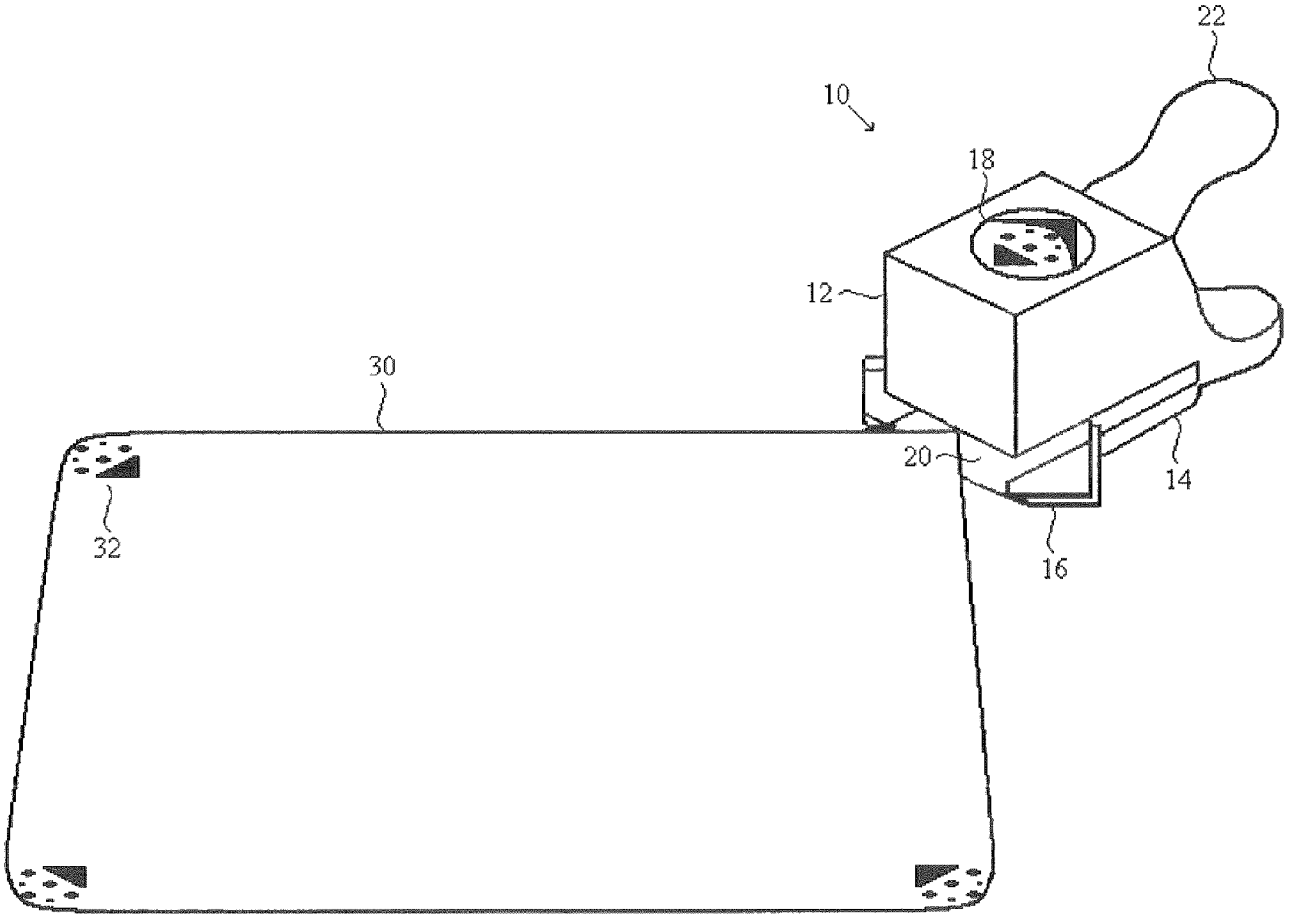
FIG. 1 depicts a front perspective view of a corner punch and target in accordance with an embodiment of the present subject matter.

All publications herein are incorporated by reference to the same extent as if each individual publication or patent application was specifically and individually indicated to be incorporated by reference. The following description includes information that may be useful in understanding the present invention. It is not an admission that any of the information provided herein is prior art or relevant to the presently claimed invention, or that any publication specifically or implicitly referenced is prior art.

One skilled in the art will recognize many methods and materials similar or equivalent to those described herein, which could be used in the practice of the present invention. Indeed, the present invention is in no way limited to the methods and materials described.

"Correspond" and "Corresponding" as used herein refers to the physical relationship between the design created by the corner punch and design created by the edge punch, wherein the corner punch and edge punch designs perfectly match and align with one another. For example, in a repeated circle design the edge punch may die-cut edge only half of a circle into the target, only to have the 'corresponding' corner punch complete the circle and continue the pattern by die-cut edging.

"Paper" as used herein refers to an item of paper, cardstock, poster material or thin material mainly used for writing upon, printing upon or for packaging, and the like.

"Die-cut edge," "Die-cut edged," and "Die-cut edging" as used herein refers to the cutting away or removal of the edge of a material with a hard (usually sharp) object to create a pattern, aperture and/or design.

"Target" as used herein refers to an item being die-cut edged by the present subject edge punch system. Examples of targets may include, but are not limited to, paper, textiles, fabric, cloth, wood, and other applicable materials known in the art.

The present subject matter discloses a system for designing paper using an edge punch and corner punch which are configured to compliment each other, creating a uniform pattern successively along the edge of a target (e.g. paper). Accordingly, the present subject matter provides a corner punch and an edge punch for edge decoration, wherein both the corner punch and edge punch each contain a two-component die with a predetermined pattern for creating a die-cut edge. The first component of the die is housed within a punching member, and corresponds with the second component of the die housed in a base member, such that the first component of the die is slideable through the second component of the die. The first component of the die is affixed to an articulating lever extending from within the punching member housing. The articulating lever is configured, upon compression toward the base member, for activating the first component of the die through the second component of the die, creating the desired die-cut edge in the target.

The corner punch has a design guide with a pattern corresponding to all or part of the die-cut edge pattern to be cut by the two-component die. The design guide may be used for visual alignment of the target with the two-component die.

The edge punch also has a design guide. The design guide on the edge punch not only corresponds with all or part of the die-cut edge pattern found on the edge punch two-component die, but also corresponds with all or part of the die-cut edge pattern found on the corner punch two-component die. The design guide is used to visually align the target with the two-component die, and more importantly to align the edge punch with a die-cut edge in the target, leading to a successive and cohesive design marking along the entire edge of a target.

Both the corner punch and edge punch also incorporate a conduit to guide the target for creating a die-cut edge. The target is abutted against the conduit, ensuring accurate placement of the target for die-cut edging. The conduit may also facilitate alignment of the edge punch design guide with an existing die-cut edge in the target. The conduit for the corner punch may be configured at an appropriate angle for aligning the target with the two-component die. The conduit for the corner punch may also incorporate at least one retractable wing for precise abutment with the target. The retractable wing also finds utility in that it functionally provides ease of storage, packaging and transport.

Broad application of the present subject matter system, device and method is also an issue as the target meant to be die-cut edged may be found in various sizes and lengths. For instance, if the design intended for die-cut edging by the edge punch is one inch in length, and the matching design intended for die-cut edging by the corner punch is one-half an inch in length, a target having an edge of less than two inches in length could not be die-cut edged, using both the edge punch and corner punch, without irregular arrangements in the design. Furthermore, taking the previous example, targets having a length not in common denomination with the combined edge punch and corner punch lengths could not be die-cut edged without irregular arrangements in the design. As it would be impossible to have a single prime length applicable for all lengths of a target, the subject matter edge punch and corner punch may be configured for use with certain common target sizes, producing a uniform cohesive design pattern in many targets.

In one embodiment, the edge punch is configured to die-cut edge a target size of 2.0 inches, and the corner punch is configured to die-cut edge a target size of 1.0 inch. Accordingly, as the corner punch may be utilized twice for any given side of a target (at each end) and the edge punch may be utilized for lengths in common denomination of 2.0 inches, target sizes capable of uniform die-cut edging by this embodiment include 4.0 inches, 6.0 inches, 8.0 inches and [(2×1.0)+(n×2.0) inches] (where n is a positive real number from 0 to infinity). In an alternative embodiment n is a positive real number from 1 to infinity.

In another embodiment, the edge punch is configured to die-cut edge a target size of 1.0 inch, and the corner punch is configured to die-cut edge a target size of 0.5 inches. Accordingly, as the corner punch may be utilized twice for any given side of a target (at each end) and the edge punch may be utilized for lengths in common denomination of 1.0 inch, target sizes capable of uniform die-cut edging by this embodiment include 2.0 inches, 3 inches, 4 inches and [(2×0.5)+(n×1.0)] (where n is a positive real number from 0 to infinity). In an alternative embodiment n is a positive real number from 1 to infinity.

In yet another embodiment, the edge punch is configured to die-cut edge a target size of "E" inches, and the corner punch is configured to die-cut edge a target size of "C" inches. Accordingly, as the corner punch may be utilized twice for any given side of a target (at each end) and the edge punch may be utilized for lengths in common denominations of E inches, target sizes capable of uniform die-cut edging by this embodiment would consist of targets measuring 2C+nE (where E=edge punch target size, C=corner punch target size, and n is a positive real number from 0 to infinity). In an alternative embodiment n is a positive real number from 1 to infinity.

In yet another embodiment, the edge punch is configured to die-cut edge a target size of "E/R" inches, and the corner punch is configured to die-cut edge a target size of "C" inches. The edge punch is configured such that the design incorporated in E inches is repeated at least "R" times, wherein R is a positive real number from 1 to infinity. Accordingly, as the corner punch may be utilized twice for any given side of a target (at each end) and the edge punch may be utilized for lengths in common denominations of E/R inches, target sizes capable of uniform die-cut edging by this embodiment would consist of targets measuring 2C+n(E/R) (where E=edge punch target size, C=corner punch target size, n is a positive real number from 0 to infinity, and R is a positive real number from 1 to infinity). In addition, continuous die-cut edging of the target for E/R inches may require overlap of the design punched on the target. As the edge punch design is configured to repeat at least one time (R is a positive real number from 1 to infinity), creating a die-cut edge of the target for lengths less than E would require overlap die-cut edging. In an alternative embodiment n is a positive real number from 1 to infinity.

Instructions for use of the corner punch and/or edge punch may be provided with the edge punch, corner punch and/or edge punch and corner punch kit. "Instructions for use" typically include a tangible expression describing the technique to be employed in using the components of the edge punch system to effect a desired outcome, such as die-cut edging of a target.

The present subject matter further discloses a device for die-cut edging paper incorporating a two-component die, where the device is configured to be foldable, allowing for economical storage, packaging and transport of the device. The subject matter edge punch incorporates two foldable wings situated at opposing ends of the edge punch device. The foldable wings may be folded upward towards the body of the edge punch device when not in use. In practice, the wings are unfolded to extend horizontally from the edge punch allowing for proper alignment of the punch. A design guide may be found on one or both wings to aid in positioning the edge punch for complimentary die-cut edging of the target. The design guide may have a pattern corresponding to all or part of the edge and/or corner pattern.

In operation, the target (e.g. paper) is selected and prepared for die-cut edging by measuring the length of each side of the target, to ensure the dimensions of the target comply with that of the die-cut edge system. The retractable wings of the corner punch may be spread, the target is placed against the corner punch conduit, and the punching member of the corner punch is compressed into the base member of the corner punch die-cut edging the subject target. Die-cut edging by the corner punch is repeated for all corners of the target for which a die-cut edge is desired (e.g., a rectangular target may be die-cut edged up to four times by the corner punch). Now, the edge punch is prepared for use by unfolding the foldable wings and abutting the target against the conduit of the edge punch. The design guide of the edge punch is aligned with the die-cut edge created by the corner punch, and once aligned, the punching member of the edge punch is compressed into the base member of the edge punch, die-cut edging the subject target. Die-cut edging by the edge punch may be repeated sequentially along the edges between corners of the target until a contemplated design is achieved. As the target was pre-measured to ensure compliance with the die-cut edge system, the die-cut edge design will align properly with any additional and existing die-cut edges, creating a cohesive design. Upon completion, the foldable wings of the edge punch are folded upwards, and the retractable wings of the corner punch are retracted, for easy storage of the edge punch and corner punch.

FIG. 1 is a perspective view of a corner punch 10, in use on a target 30. The corner punch 10 comprises a corner punching member 12 housing the first component of the die, and a corner base member 14 housing the second component of the die, wherein the first component of the die is attached to a lever 22 such that compression of the lever 22 towards the corner base member 14 enacts the first component die to be punched through the target 30 into the corresponding second component of the die found housed in the corner base member 14. The corner punch 10 includes a conduit 20, found between the corner punching member 12 and corner base member 14, for abutment against the target 30. The corner punch 10 may further include at least one retractable wing 16 for physical guiding of the target 30 against the corner punch 10. The corner punching member 12 of the corner punch 10 also incorporates a design guide 18, displaced thereon, for visual alignment of the design onto the target 30. In operation, the target 30 is abutted against the conduit 20 and the at least one retractable wing 16. Once in place, the lever 22 is compressed towards the corner base member 14, through the target 30, and released, die-cut edging the target 30 with a corner punch design 32.

Figure 2A:
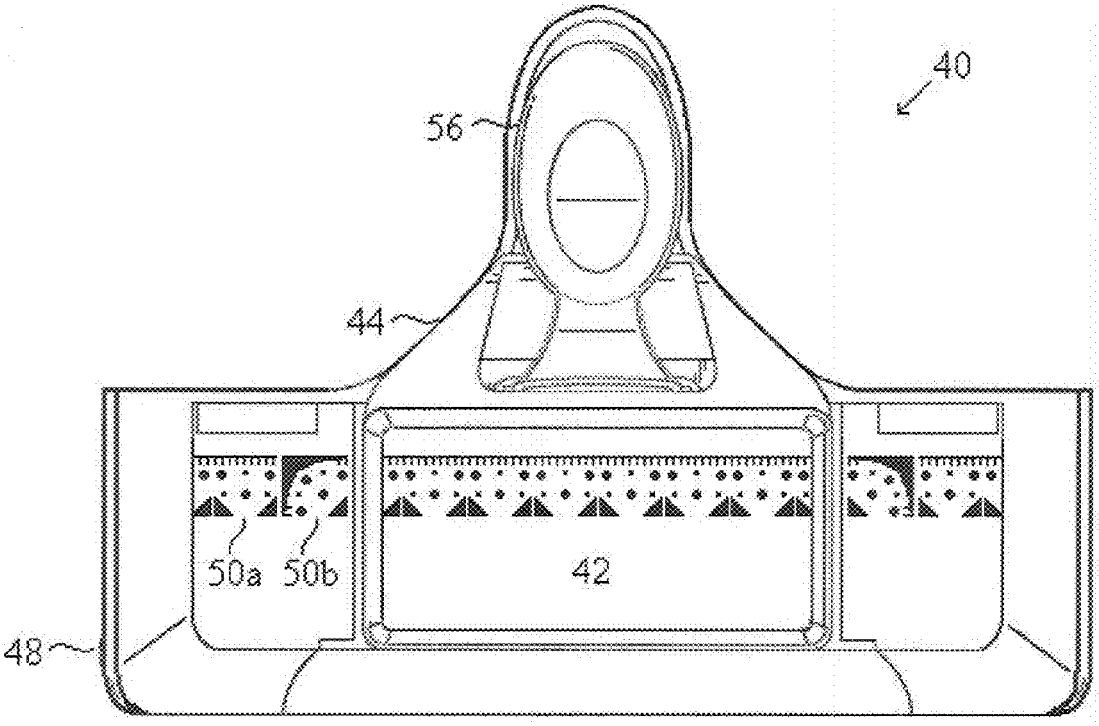
FIG. 2*a* depicts an overhead view of an edge punch in accordance with an embodiment of the present subject matter.

FIG. 2*a* depicts an overhead view of a contemplated edge punch 40. The edge punch 40 comprises an edge punching member 42 housing the first component of the die, and an edge base member 44 housing the second component of the die. The first component of the die is attached to a lever 56 such that compression of the lever 56 towards the edge base member 44 enacts the first component die to be punched through the target 30 into the corresponding second component of the die found housed in the edge base member 44. The edge punch 40 further includes at least one folding wing 48. The folding wing 48 incorporates an edge punch design guide 50*a* and a corner punch design guide 50*b*, placed upon the face of the folding wing 48, for aligning the corresponding design guide 50*a* or 50*b* with the design found on the target 30. The edge punch design guide 50*a* includes a pattern corresponding to all or part of the die-cut edged pattern found on the edge punch two-component die, while the corner punch design guide 50*b* includes a pattern corresponding to all or part of the die-cut edge pattern found on the corner punch design guide 50*b*.

Figure 2B:
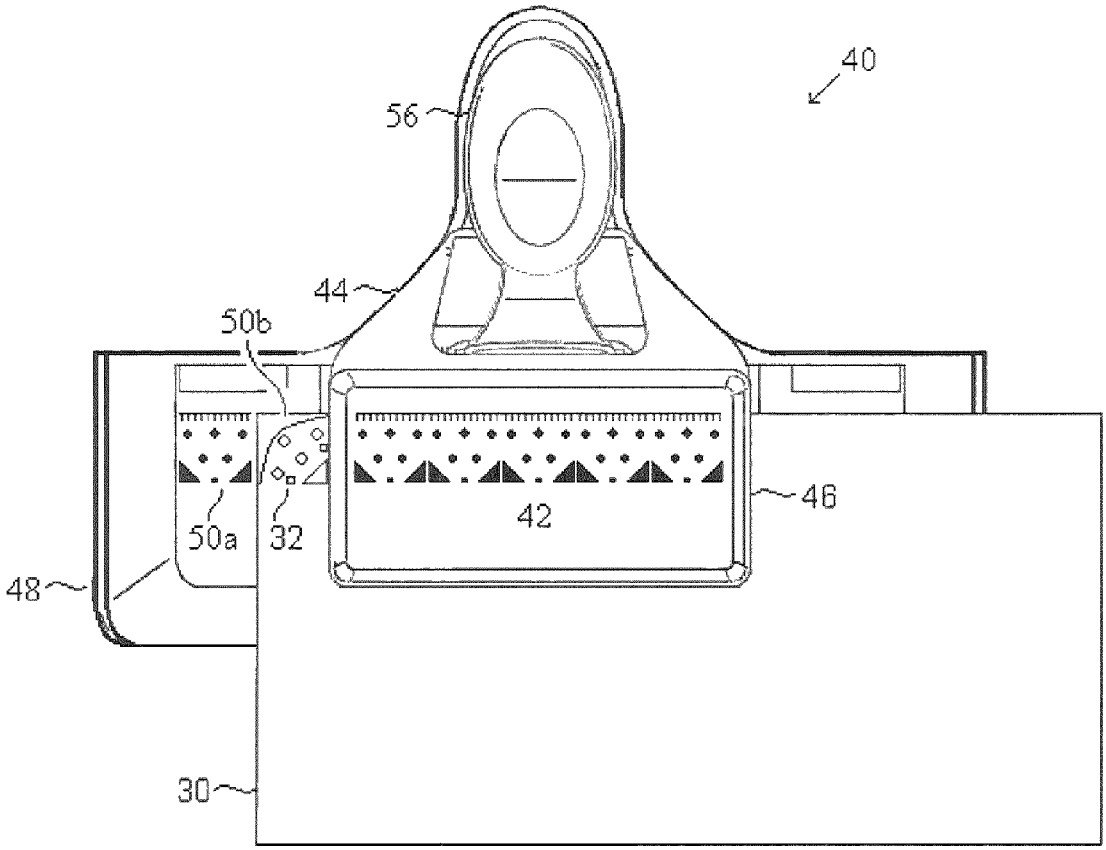
FIG. 2*b* depict an overhead view of an edge punch and target in accordance with an embodiment of the present subject matter.

FIG. 2*b* depicts an overhead view of a contemplated edge punch 40, in use on a target 30, which has been die-cut edged with a corner punch design 32. The target 30 is abutted against the edge punch conduit 46 and the die-cut edged corner punch design 32 is aligned with the corner punch design guide 50*b* found on the folding wing 48. Once the corner punch design 32 is aligned with the corner punch design guide 50*b*, the lever 56 is compressed towards the edge base member 44, through the target 30, and released, die-cut edging the target 30 with the edge punch design. Alignment of the corner punch design 32 with the corner punch design guide 50*b* prior to enacting the edge punch ensures that the corner punch design 32 properly aligns with the edge punch design.

Figure 2C:
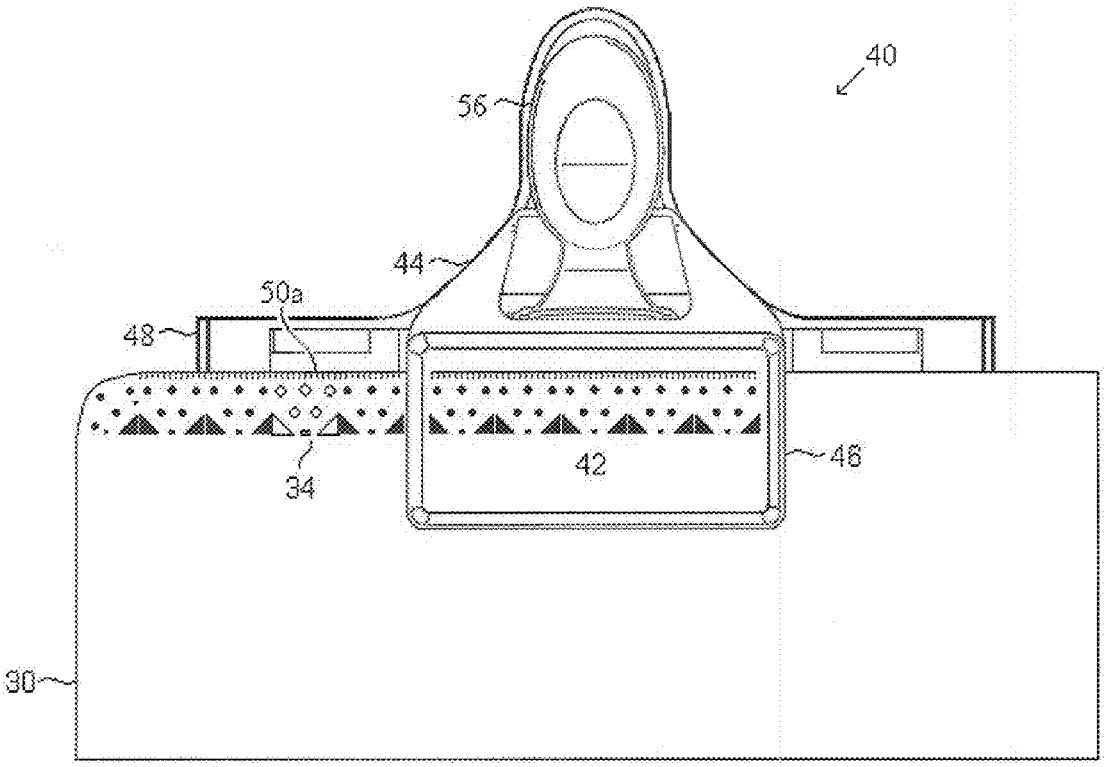
FIG. 2*c* depict an overhead view of an edge punch and target in accordance with an embodiment of the present subject matter.

FIG. 2*c* depicts an overhead view of a contemplated edge punch 40, in use on a target 30, which has been die-cut edged with an edge punch design 34. The target 30 is abutted against the edge punch conduit 46 and the die-cut edged edge punch design 34 is aligned with the edge punch design guide 50*a* found on the folding wing 48. Once the edge punch design 34 is aligned with the edge punch design guide 50*a*, the lever 56 is compressed towards the edge base member 44 through the target 30 and released, die-cut edging the target 30 with the edge punch design 34. Alignment of the edge punch design 34 with the edge punch design guide 50*a* prior to enacting the edge punch ensures that the edge punch design 34 is die-cut edged into the target in alignment with the existing edge punch design 34.

Figure 3A:
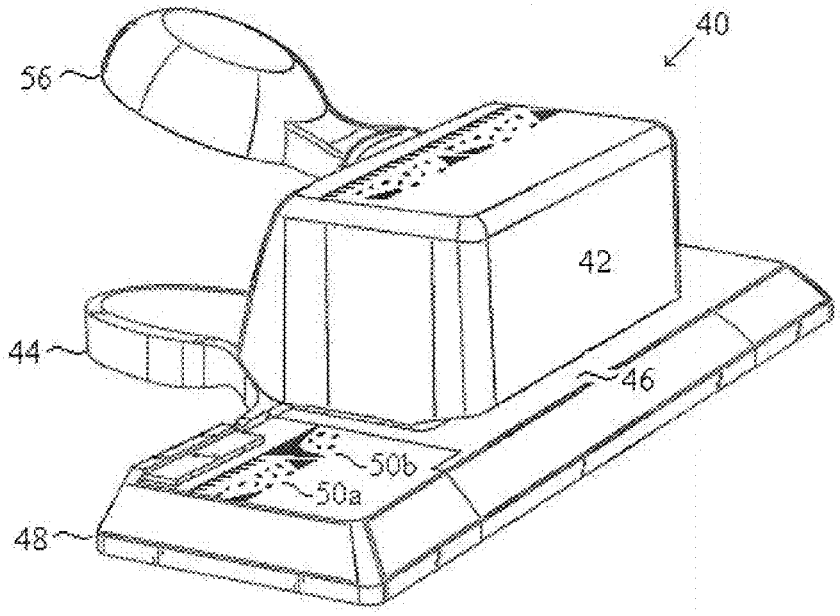
FIG. 3*a* depicts a front perspective view of an edge punch and target in accordance with an embodiment of the present subject matter.

FIG. 3*a* is a perspective view of a contemplated edge punch 40, in use on a target 30. The edge punch 40 comprises an edge punching member 42 housing the first component of the die, and an edge base member 44 housing the second component of the die. The first component of the die is attached to a lever 56 such that compression of the lever 56 towards the edge base member 44 enacts the first component die to be punched through the target 30 into the corresponding second component of the die found housed in the edge base member 44. The edge punch 40 includes a conduit 46, found between the edge punching member 42 and edge base member 44, for abutment against the target 30. The edge punch 40 further includes at least one folding wing 48. The folding wing 48 incorporates an edge punch design guide 50*a* and a corner punch design guide 50*b*, placed upon the face of the folding wing 48, for aligning the corresponding design guide 50*a* or 50*b* with the design found on the target 30. The edge punch design guide 50*a* includes a pattern corresponding to all or part of the die-cut edged pattern found on the edge punch two-component die, while the corner punch design guide 50*b* includes a pattern corresponding to all or part of the die-cut edged pattern found on the corner punch design guide 50*b*.

In operation, the target 30 is abutted against the conduit 46 and the corresponding edge punch design guide 50*a* is aligned with an edge punch design 34 already punched in the target 30, or the corner punch design guide 50*b* is aligned with a corner punch design 32 already punched in the target 30. Once in place, the lever 56 is compressed towards the edge base member 44, through the target 30, and released, die-cut edging the target 30 with the edge punch design 34. Alignment of the corner punch design 32 with the corner punch design guide 50*b* prior to enacting the edge punch ensures that the corner punch design 32 properly aligns with the edge punch design 34. Similarly, aligning the edge punch design 34 with the edge punch guide 50*a* found on the folding wing 48 of the edge punch 40, ensures that the already-existing and the new edge punch designs 34 properly align with one another.

Figure 3B:
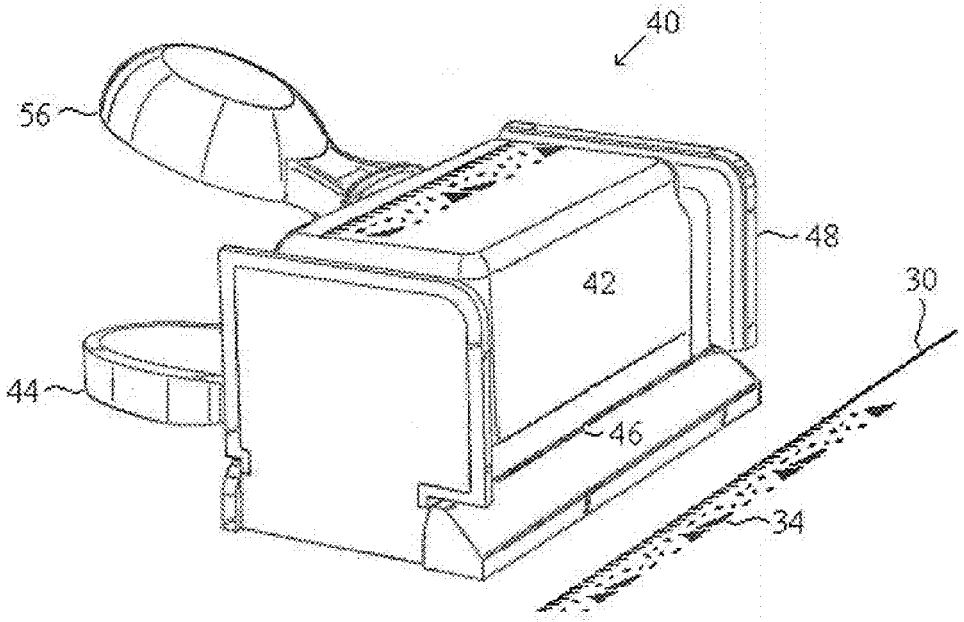
FIG. 3*b* depicts a front perspective view of an edge punch and target in accordance with an embodiment of the present subject matter.

FIG. 3*b* depicts a perspective view of a contemplated edge punch 40, after it has been used on a target 30. Similar to FIG. 2*a*, FIG. 3*b* depicts components of the edge punch, however, the folding wings 48 are folded upwards towards the edge punch in a substantially vertical orientation for ease of storage and transport.

Figure 4:
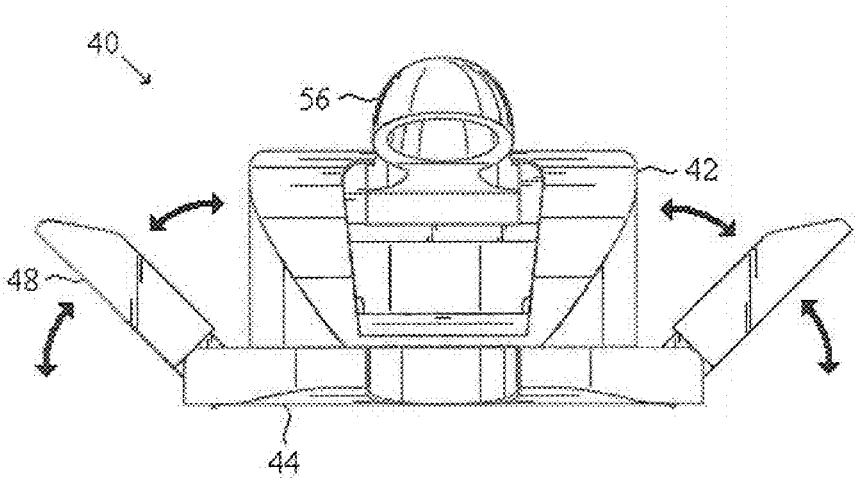
FIG. 4 depicts a rear view of an edge punch with retracting wings in accordance with an embodiment of the present subject matter.
Figure 5:
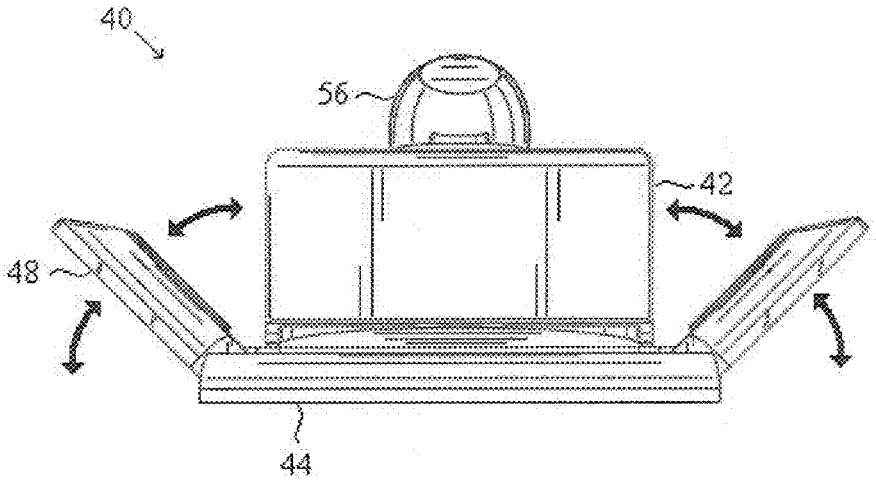
FIG. 5 depicts a front view of an edge punch with retracting wings in accordance with an embodiment of the present subject matter.

FIGS. 4 and 5 show a rear and a front perspective view, respectively, of a contemplated edge punch 40 showing the operational functionality of the folding wings 48. When operating the edge punch 40, the folding wings 48 are opened in a horizontal orientation. For storage and shipping purposes, the folding wings 48 are retracted upwards towards the body 42 of the edge punch 40. The folding wings 48 are illustrated in a transitional state between the horizontal orientation and retracted orientation.

EXAMPLE

The following example is provided to better illustrate the claimed subject matter and is not to be interpreted as limiting the scope of the subject matter. To the extent that specific materials are mentioned, it is merely for purposes of illustration and is not intended to limit the subject matter. One skilled in the art may develop equivalent means or reactants without the exercise of inventive capacity and without departing from the scope of the subject matter.

The subject matter punch system is used with a rectangular target measuring 3.25 inches by 5 inches. The method for punching the target is commenced by opening the retractable wings of the corner punch and abutting a corner of the target into the corner punch conduit. The target is abutted against the conduit and held in place, while the lever found adjacent to the punching member is compressed towards the corner base member. Upon compression of the lever, the first component of the die, housed in the corner punching member, is enacted by the lever and travels towards the second component of the die, housed in the corner base member. The first component of the die punches through the target and into the second component die, resulting in a complete die-cut edge of the target with the design found in the die. The lever is released and the target is removed from the conduit. The remaining three corners of the target are die-cut edged by repeating the steps described above.

After die-cut edging the corners of the subject target with the corner punch, the edge punch is retrieved and the folding wings of the edge punch are opened to a horizontal position. The target is inserted into the edge punch conduit and abutted against the conduit. The die-cut edge punched by the corner punch is located on the target and aligned with the corner punch design guide found on a retractable wing of the edge punch. Once aligned, the lever found adjacent to the edge punching member is compressed towards the edge base member. Upon compression of the lever, the first component of the die, housed in the edge punching member, is enacted by the lever and travels towards the second component of the die, housed in the edge base member. The first component of the die punches through the subject target and into the second component die, resulting in complete die-cut edging of the target with the design found in the die. The edge punch design and corner punch design are properly aligned. The remainder of this side and other desirable sides of the target are die-cut edged by repeating the steps described above; in each case, using the corner or the edge or both the corner and the edge designs to guide the punching of the next segment of the target.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Accordingly, the invention is not limited except as by the appended claims.

What is claimed is:

1. A system for die-cut edging a target, comprising:

an edge punch, comprising:

an edge punching member, an edge base member comprising a first wing portion and a second wing portion, the first and second wing portions extending outwardly from opposing sides of the edge punching member, and the first and second wing portions are each independently retractable from a horizontal to a vertical orientation with respect to the edge base member, a two-component edge punch die with a predetermined edge pattern for creating a die-cut edge, said two-component edge punch die comprising a first edge die component housed in the edge punching member and a second edge die component housed in the edge base member, wherein the first edge die component is slideable through the second edge die component, a lever attached to the first edge die component;

a first and a second edge punch design guide pattern, located on the first wing portion and the second wing portion, respectively, and a first and a second corner punch design guide pattern, located on the first wing portion and the second wing portion, respectively, the first and second corner punch design guide pattern being different from the first and second edge punch design guide pattern, respectively; and a corner punch, the corner punch being separate from the edge punch, the corner punch comprising:

a corner punching member, a corner base member, and a two-component corner punch die with a predetermined corner pattern for creating a die-cut corner edge, said two-component corner punch die comprising a first corner die component housed in the corner punching member and a second corner die component housed in the corner base member, wherein the corner pattern formed by two-component corner punch die is different than the edge pattern formed by the two-component edge punch die, and wherein the first corner die component is slideable through the second corner die component, wherein the first and second edge punch design guide patterns each correspond with at least a portion of the predetermined edge pattern for creating a die-cut edge, the first and second corner punch design guide patterns located on the first wing portion and the second wing portion, respectively, of the edge punch each correspond with at least a portion of the predetermined corner pattern for creating a die-cut corner edge of the two-component corner punch, and the predetermined edge pattern and predetermined corner pattern correspond with one another such that the corner punch design guide patterns on the first wing portion and the second wing portion serve to align the formation of the edge pattern.

2. The system of claim 1, wherein the edge punch further comprises an edge punch conduit configured to guide the target for creating a die-cut edge and wherein the first wing portion and the second wing portion include a edge guide surface adjacent the design guide patterns, the edge guide surfaces aligned with the edge punch conduit.

3. The system of claim 1, wherein the corner punch further comprises a corner punch conduit configured to guide the target for creating a die-cut edge.

4. The system of claim 1, wherein the corner punch further comprises a corner punch design guide for visual orientation of the target in the corner punch.

5. The system of claim 1, configured such that use of the system with respect to the target results in creating a die-cut edge of the target with the predetermined edge pattern and the predetermined corner pattern aligning properly when the target has a length along each of its die-cut edge sides of the formula:

$$2C+nE,$$

where E is the length of the edge pattern, C is the length of the corner pattern, and n is a positive real number from 1 to infinity.

6. The system of claim 5, wherein E=1.75 inches and C=0.75 inches.

7. The system of claim 5, wherein E=1.0 inch and C=0.50 inches.

8. The system of claim 5, wherein E=2.0 inches and C=1.0 inch.

9. The system of claim 1, configured such that use of the system with respect to the target results in creating a die-cut edge of the target with the predetermined edge pattern and the predetermined corner pattern aligning properly when the target has a length along each of its die-cut edge sides of the formula:

$$2C+n(E/R),$$

where E is the length of the edge pattern, C is the length of the corner pattern, n is a positive real number from 1 to infinity, and R is a positive real number from 1 to infinity.

10. An edge punch for use with a corresponding corner punch, comprising:

an edge punching member;

an edge base member comprising a first wing portion pivotably attached to the base member on a first side of the punching member, and a second wing portion pivotably attached to the base member on a second side of the punching member, the first and second wing portions are each independently retractable from a horizontal to a vertical orientation with respect to the edge base member;

a two-component edge punch die with a predetermined edge pattern for creating a die-cut edge, said two-component edge punch die comprising a first edge die component housed in the edge punching member and a second edge die component housed in the edge base member, wherein the first edge die component is slideable through the second edge die component;

a first and a second edge punch design guide pattern corresponding to the edge pattern, located on the first wing and second wing, respectively, and a first and a second corner punch design guide pattern corresponding to a corner punch pattern that is different than the edge pattern, located on the first wing and second wing, respectively, the first and second edge punch and corner punch design guide patterns exposed when the first and second wing portions are in the horizontal orientation, and the first and second corner punch design guide patterns corresponding to a predetermined cutting pattern of the corner punch and being different from the first and second edge punch design guide patterns, respectively, such that the corner punch design guide patterns on the first wing portion and the second wing portion serve to align the formation of the edge pattern; and a lever attached to the first edge die component.

11. A punch for creating a die-cut pattern in a target, comprising:

a punching member;

a base member comprising a first wing portion, and a second wing portion, the first and second wing portions are each independently retractable from a horizontal to a vertical orientation with respect to the edge base member; and a two-component punch die with a predetermined edge pattern for creating a die-cut edge, said two-component punch die comprising a first die component housed in the punching member and a second die component housed in the base member, wherein the first die component is slideable through the second die component, a first punch design guide pattern and a second punch design guide pattern located on the first wing portion and second wing portion, respectively, the first and second punch design guides corresponding to the predetermined edge pattern of the two-component punch die, and a third punch design guide pattern and a fourth punch design guide pattern, located on the first wing portion and second wing portion, respectively, the third and fourth punch design guides corresponding to a predetermined cutting pattern of a separate punch and being different from the first and second punch design guide pattern, respectively;

wherein the predetermined pattern of the two-component punch die is configured such that punches made using the punch at sequential edge positions of the target result in a unitary, predetermined die-cut pattern around the edge of the target; and wherein the predetermined edge pattern of the two-component punch die is different than and corresponds to the predetermined cutting pattern of the separate punch, wherein the first and second design guide pattern and third and fourth design guide patterns correspond with one another such that the third and fourth design guide patterns on the first wing portion and the second wing portion serve to align the formation of the predetermined edge pattern.

12. The punch of claim 11, wherein the target has four corners.

13. The punch of claim 12, wherein the punch is configured to be used twice for each side of the target to die-cut a complete edge pattern about the target.

* * * * *